US012338404B2

(12) United States Patent
Dauphin et al.

(10) Patent No.: US 12,338,404 B2
(45) Date of Patent: Jun. 24, 2025

(54) FUEL COMPOSITION RICH IN AROMATIC COMPOUNDS, PARAFFINS AND ETHANOL, AND USE THEREOF IN PARTICULAR IN COMPETITION MOTOR VEHICLES

(71) Applicant: TotalEnergies OneTech, Courbevoie (FR)

(72) Inventors: Roland Dauphin, Brussels (BE); Lisa Serve, Givors (FR)

(73) Assignee: TotalEnergies OneTech, Courbevoie (FR)

( * ) Notice: Subject to any disclaimer, the term of this patent is extended or adjusted under 35 U.S.C. 154(b) by 0 days.

(21) Appl. No.: 18/557,903

(22) PCT Filed: Apr. 29, 2022

(86) PCT No.: PCT/FR2022/050825
§ 371 (c)(1),
(2) Date: Oct. 27, 2023

(87) PCT Pub. No.: WO2022/229573
PCT Pub. Date: Nov. 3, 2022

(65) Prior Publication Data

US 2024/0218274 A1 Jul. 4, 2024

(30) Foreign Application Priority Data

Apr. 30, 2021 (FR) ..... 2104537

(51) Int. Cl.
*C10L 1/02* (2006.01)

(52) U.S. Cl.
CPC ..... *C10L 1/023* (2013.01); *C10L 2200/0415* (2013.01)

(58) Field of Classification Search
CPC ..... C10L 1/023; C10L 2200/0415
See application file for complete search history.

(56) References Cited

U.S. PATENT DOCUMENTS

2005/0279018 A1* 12/2005 Cracknell ..... C10L 1/06 44/436
2015/0144087 A1* 5/2015 Rantanen-Kolehmainen ..... C10G 3/52 44/449
2018/0230391 A1 8/2018 Price et al.
2021/0238492 A1* 8/2021 Choi ..... C10L 1/1691

FOREIGN PATENT DOCUMENTS

| | | | |
|---|---|---|---|
| EP | 1068282 B1 | | 1/2001 |
| ES | 2362860 | * | 7/2011 |
| KR | 100741641 | * | 8/2007 |
| WO | WO 99/49003 A1 | | 9/1999 |
| WO | WO 2022/229573 A1 | | 3/2022 |

OTHER PUBLICATIONS

International Search Report for PCT/FR2022/050825 dated Apr. 29, 2022, 2 pages.

* cited by examiner

*Primary Examiner* — Cephia D Toomer
(74) *Attorney, Agent, or Firm* — Quarles & Brady, LLP

(57) ABSTRACT

The present invention relates to a fuel composition comprising: (i) 60 to 94% by mass of a hydrocarbon mixture comprising: (a) 35 to 55% by mass of aromatic compounds; (b) 30 to 50% by mass of a mixture of n-paraffins and iso-paraffins containing at least 5 carbon atoms, with a ratio of the amount of iso-paraffins to the amount of n-paraffins greater than or equal to 3; and (c) 5 to 15% by mass of naphtenes; (ii) 5 to 36% by mass of ethanol; and (iii) 1 to 10% by mass of butane. This composition is useful for fuelling a spark ignition engine in motor vehicles intended for use by the general public or in competition.

16 Claims, No Drawings

FUEL COMPOSITION RICH IN AROMATIC COMPOUNDS, PARAFFINS AND ETHANOL, AND USE THEREOF IN PARTICULAR IN COMPETITION MOTOR VEHICLES

CROSS-REFERENCE TO RELATED APPLICATIONS

This application claims priority to and is a 35 U.S.C. § 371 national phase application of PCT/FR2022/050825 (WO2022/229573), filed on Apr. 29, 2022, entitled "Fuel Composition Rich in Aromatic Compounds, Paraffins and Ethanol, and Use Thereof in Particular in Competition Motor Vehicles", which application claims priority to, and the benefit of, French patent application number FR2104537, filed Apr. 30, 2021, the disclosures of which are incorporated herein by reference in their entirety.

One object of the present invention is a fuel composition intended for vehicles including a spark ignition engine (or gasoline engine), and which has advantageous properties.

Another object of the invention is the use of such a composition to fuel a spark ignition engine, both in a conventional, especially automobile, vehicle, and in a racing vehicle.

Gasoline-type fuels usable in spark ignition engines, especially those in automobile vehicles, should have sufficiently high octane numbers to avoid knocking phenomena.

As is well known, the octane number measures resistance of a fuel used in a spark ignition engine to auto-ignition.

Typically, gasoline fuels marketed in Europe, in accordance with standard EN 228, have a Motor Octane Number (MON) greater than 85 and a Research Octane Number (RON) of at least 95. These fuels are suitable for the vast majority of automobile engines.

In order to increase their efficiency, modern spark ignition engines tend to operate with increasingly higher compression ratios, that is with a high compression ratio applied to the fuel/air mixture in the engine before it is ignited.

However, increasing the volumetric compression ratio in an engine increases the risk of abnormal knocking-type combustion, generated by local auto-ignition of the fuelled mixture upstream of the flame front. This phenomenon creates a characteristic noise and is liable to damage the engine.

For very high-power engines, such as those used in racing vehicles, a high compression volume ratio is particularly desirable.

For this type of engines, it is therefore essential to use fuels with a high resistance to knocking and pre-ignition, resulting in fuels with "research" octane numbers (RON) that are as high as possible. If the octane numbers are insufficient, the phenomenon of knocking or auto-ignition of the fuel is likely to occur, which can significantly reduce engine performance and even cause serious engine damage.

In addition, for all vehicles and especially those intended for use in general public applications, there is a growing trend to use fuels formulated from plant-based bases, and especially so-called "biosourced" bases, in order to respond to environmental concerns and limit the use of fossil resources. Current environmental concerns are driving consumers to look for more environmentally-friendly fuels.

However, the use of fuel compositions based on biosourced bases should not be to the detriment of fuel performance, and in particular octane number and engine power, which should be maintained or even increased.

The most commonly used gasoline fuels with a high biocompound content are those containing bioethanol, such as E85, E10 and E5. However, the use of these fuels represents a small proportion of the current automotive market.

Bioethanol is known to be mixed with a gasoline fuel of the SP95 type. The ethanol content is then limited to a maximum of 10% by volume in order to comply with the specifications of standard EN 228, especially relating to the incorporation of oxygenated compounds.

There is therefore a need to develop new fuel compositions for fuelling spark ignition engines that meet the requirements of modern vehicles, whether they are intended for use in general public applications (light vehicles, heavy goods vehicles, off-road vehicles, etc.) or for competition.

There is therefore a need for fuels for spark ignition internal combustion engines which have a high octane number, and in particular a high RON, and which make it possible to maximise engine power of automobile vehicles operating with a high volumetric compression ratio, especially racing vehicles.

One purpose of the present invention is therefore to improve performance of gasoline fuel compositions, in particular but not exclusively fuel compositions intended for racing vehicles. The purpose is to increase energy content of the fuel, which will result in an increase in the power of the spark ignition engine, whether of the atmospheric or turbocharged type, during combustion of the gasoline fuel composition in the engine.

There is also a growing need to be able to formulate such compositions from bases and/or compounds of renewable origin, also known as biosourced compounds.

As is well known in prior art, octane booster additives are typically added to gasoline-type fuel compositions. Organometallic compounds comprising in particular iron, lead or manganese are well-known octane boosters.

Tetraethyl lead (TEL) has thus been widely used as a very effective octane booster. However, in most parts of the world, TEL and other organometallic compounds can now only be used in fuels in very small amounts, if at all, as they can be toxic, cause engine damage and are harmful to the environment.

Non-metal based octane boosters include oxygenates (for example ethers and alcohols) and aromatic amines. However, these additives also suffer from various drawbacks. For example, N-methylaniline (NMA), an aromatic amine, should be used at a relatively high treatment rate (1.5 to 2% by weight of additive/fuel base weight) to have a significant effect on the octane number of the fuel. NMA can also be toxic.

By way of example, document U.S. Pat. No. 4,812,146 describes unleaded gasoline fuel compositions for racing engines which comprise at least four components selected from butane, isopentane, toluene, MTBE (methyl tert-butyl ether) and an alkylate.

Document WO2010/014501 describes unleaded gasoline fuel compositions comprising at least 45% by volume of branched paraffins, at most 34% by volume of one or more mono- and di-alkylated benzenes, from 5 to 6% by volume of at least one linear paraffin having from 3 to 5 (noted C3-C5) carbon atoms, one or more alkanols having from 2 to 4 (noted C2-C4) carbon atoms, in sufficient amount to increase the AKI (Anti Knock Index) that is (RON+MON)/2 by at least 93. These compositions are presented as having high torque and maximum power.

Fuel compositions with good intrinsic properties are therefore sought, that is without necessarily requiring the addition of octane boosters such as those described above.

Continuing its research into the development of fuel formulations for gasoline engines, the Applicant has now discovered a composition which makes it possible to meet the above purposes.

One object of the present invention is therefore a fuel composition comprising:

(i) from 60 to 94% by weight of a hydrocarbon mixture comprising:

a) from 35 to 55% by weight of aromatic compounds;

b) from 30 to 50% by weight of a mixture of n-paraffins and iso-paraffins containing at least 5 carbon atoms with a weight ratio of the amount of iso-paraffins to the amount of n-paraffins greater than or equal to 3; and c) from 5 to 15% by weight of naphthenes;

(ii) from 5 to 36% by weight of ethanol; and (iii) from 1 to 10% by weight s of butane.

These compositions are intended for use fuelling in spark ignition engines (or gasoline engines).

The fuel compositions according to the invention have high RON (Research Octane Number) octane numbers.

In applications where the fuel flow rate is capped, especially in the case of racing vehicles, the use of the composition according to the invention makes it possible to achieve higher levels of engine power at a constant fuel flow rate.

In particular, formulating a composition with the compounds and in the specific proportions defined above has been shown to make it possible to obtain synergistic performance in terms of RON octane number and engine power.

These properties are particularly sought after for use in racing vehicles.

The composition according to the invention also offers significant advantages for uses other than in racing vehicles, such as, for example, so-called general public uses, especially for light vehicles (or LV). If necessary, it can meet the specifications of standard EN 228.

The composition according to the invention can advantageously be prepared, in whole or in part, from bases and/or compounds of plant origin. In particular, the composition according to the invention may contain at least 50% by weight of one or more biosourced bases, preferably at least 60% by weight, and even more preferably at least 75% by weight of one or more biosourced bases.

Another object of the invention is the use of the composition according to the invention to fuel a spark ignition engine.

According to one particular embodiment, the composition according to the invention is used as a fuel for a high-efficiency, high-power spark ignition engine, preferably a racing vehicle engine.

Other objects, characteristics, aspects and advantages of the invention will become even more clearer upon reading the following description and examples.

In what follows, and unless otherwise indicated, the limits of a range of values are included in this range, especially in the expressions: "between . . . and . . . ", "in the range from . . . to . . . ", and "from . . . to . . . ".

Furthermore, the expressions "at least one" and "at least" used in the present description are respectively equivalent to the expressions "one or more" and "greater than or equal to".

Finally, in a manner known per se, a $C_N$ compound is a compound containing N carbon atoms in its chemical structure, and $C_{N+}$ compounds are compounds containing at least N carbon atoms.

The Fuel Composition

The composition according to the invention contains a mixture (i) of hydrocarbons containing:

a) from 35 to 55% by weight of aromatic compounds;

b) from 30 to 50% by weight of a mixture of n-paraffins and iso-paraffins containing at least 5 carbon atoms with a weight ratio of the amount of iso-paraffins to the amount of n-paraffins greater than or equal to 3; and c) from 5 to 15% by weight of naphthenes.

These contents are expressed by weight, relative to the weight of the hydrocarbon mixture (i).

Such a hydrocarbon mixture represents from 60 to 94% by weight, relative to the total weight of the fuel composition, preferably from 65 to 90% by weight, more preferably from 70 to 85% by weight, even more preferably from 70 to 80% by weight, relative to the total weight of the fuel composition.

The aromatic compound or compounds (i)a) is (are) preferably selected from alkyl-benzenes comprising from 7 to 12 carbon atoms. By alkyl-benzenes, it is meant, in a manner known per se, benzene derivatives in which one or more hydrogen atoms are replaced with one or more alkyl groups.

The aromatic compound(s) may in particular be selected from toluene, ethylbenzene, xylenes (and especially 1,2-dimethylbenzene or ortho-xylene, 1,3-dimethylbenzene or meta-xylene and 1,4-dimethylbenzene or para-xylene), 1-ethyl-3-methylbenzene, mesitylene (1,3,5-trimethylbenzene), 1-ethyl-3,5-dimethylbenzene, and mixtures of these compounds.

Mixtures of aromatic compounds are particularly preferred, and more particularly mixtures of alkyl-benzenes containing 8 to 10 carbon atoms, such as ethylbenzene, xylenes (and especially 1,2-dimethylbenzene or ortho-xylene, 1,3-dimethylbenzene or meta-xylene and 1,4-dimethylbenzene or para-xylene), 1-ethyl-3-methylbenzene, mesitylene (1,3,5-trimethylbenzene) and 1-ethyl-3,5-dimethylbenzene.

Preferably, the content of the aromatic compounds (i)a) ranges from 40 to 53% by weight, preferably from 45 to 52% by weight s, relative to the weight of the hydrocarbon mixture (i).

The composition according to the invention further contains paraffins (i)b) containing at least 5 carbon atoms. These paraffins are non-cyclic and consist of a mixture of n-paraffins and isoparaffins.

By "paraffins», it is meant, in a manner known per se, branched alkanes (also called iso-paraffins or iso-alkanes) and unbranched alkanes (also called n-paraffins or n-alkanes).

Paraffins are preferably selected from those comprising from 5 to 12 carbon atoms, more preferably from 5 to 9 carbon atoms, and even more preferably from 5 to 8 carbon atoms.

Paraffins include n-paraffins (or normal-paraffins, that is linear alkanes) and iso-paraffins (that is branched alkanes).

Mixtures of n-paraffins and iso-paraffins selected from those described above are used, comprising a major proportion of iso-paraffins, with a weight ratio of the amount of iso-paraffins to the amount of n-paraffins greater than or equal to 3, preferably greater than or equal to 4 and better still in the range from 4 to 5.

The hydrocarbon mixture (i) advantageously contains from 5 to 10% by weight of n-paraffins and from 20 to 45% by weight of iso-paraffins.

Preferably, the content of paraffins (i)b) ranges from 32 to 45% by weight, more preferably from 35 to 42% by weight, relative to the weight of the hydrocarbon mixture (i).

The composition according to the invention further contains naphthenes (i)c).

By "naphthenes», it is meant, in a manner known per se, cyclic alkanes (or cycloalkanes) containing from 5 to 10 carbon atoms. Preferably, the naphthenes are selected from cyclic alkanes containing from 5 to 10 carbon atoms, and more preferably from 6 to 9 carbon atoms.

Preferably, the content of naphthenes (i)c) ranges from 7 to 13% by weight, more preferably from 8 to 12% by weight, relative to the weight s of the hydrocarbon mixture (i).

According to one preferred embodiment, the hydrocarbon mixture (i) is derived from plant raw materials. Thus, the mixture (i) advantageously consists entirely of biosourced hydrocarbons. The original plant raw materials may, for example, be selected from cereals (wheat, maize), rapeseed, sunflower, soya, palm oil, sugar cane, beet, wood waste, straw, bagasse, grape marc, used vegetable cooking oils, algae and lignocellulosic materials.

The composition according to the invention also contains ethanol.

According to one preferred embodiment, ethanol of plant origin, also known as bioethanol, is used.

Bioethanol can be produced, for example, from the fermentation of sugars, mainly glucose, using conventional or genetically modified yeast strains. Different plant raw materials can be used to produce bioethanol, such as sugar cane, maize, barley, potato waste, sugar beet and wine residues such as grape marc.

The composition has an ethanol content ranging from 5 to 36% by weight, preferably from 10 to 30% by weight, and even more preferably from 20 to 25% by weight, relative to the total weight of the fuel composition.

The composition according to the invention also contains butane, which may be selected from n-butane (linear butane), iso-butane (2-methylpropane) and mixtures of these two compounds.

A mixture of n-butane and iso-butane is preferably used.

The composition has a butane content ranging from 1 to 10% by weight, preferably from 1.5 to 8% by weight, and still better from 2 to 6% by weight, relative to the total weight of the fuel composition.

According to a preferred embodiment, the composition according to the invention comprises at most 2.5% by weight of olefins, preferably at most 2% by weight of olefins, more preferably at most 1% by weight of olefins, still more preferably at most 0.5% by weight of olefins.

The composition as described above generally has a research octane number (RON number) greater than or equal to 95, preferably greater than or equal to 99, and more preferably greater than or equal to 100, RON being measured according to standard ASTM D 2699-86.

The above values relate to the intrinsic octane number of the composition, that is without the addition of additional compounds such as especially octane booster additives.

In addition to the base compounds described above, the fuel composition according to the invention may also comprise one or more additives selected from those usually employed in gasoline fuels.

In particular, the composition according to the invention may comprise at least one detergent additive ensuring the cleanliness of the intake circuit. Such an additive may, for example, be selected from the group consisting of succinimides optionally substituted with a polyisobutylene group, polyetheramines, betaines, Mannich bases and quaternary ammonium salts, for example those described in documents U.S. Pat. No. 4,171,959 and WO2006135881.

The composition may also comprise at least one lubricity additive or anti-wear agent, especially (but not limited to) selected from the group consisting of fatty acids and their ester or amide derivatives, especially glycerol monooleate, and mono- and polycyclic carboxylic acid derivatives. Examples of such additives are given in the following documents: EP680506, EP860494, WO98/04656, EP915944, FR2772783, FR2772784.

Other additives may also be incorporated into the fuel composition according to the invention, such as anti-valve recession additives and antioxidant additives.

The additives described above may be added in amounts ranging, for each of them, from 10 to 1000 ppm by weight, preferably from 100 to 500 ppm by weight in the fuel composition.

According to one preferred embodiment, the composition comprises an additive package, that is a combination of at least two different additives, advantageously selected from detergent additives, lubricity additives, anti-valve recession additives and antioxidant additives. These additives are advantageously selected from those mentioned above.

The fuel compositions according to the invention have a lead content generally less than or equal to 5 mg/L (present, for example, in the form of tetraethyl lead) and, preferably, are lead-free, that is they do not contain lead or lead-containing compounds.

Preparation of the Fuel Composition

The composition according to the invention can be prepared by simply mixing its constituents.

A first non-limiting embodiment comprises the following steps:

1) preparing a hydrocarbon mixture (i) comprising from 35 to 55% by weight of aromatic compounds, from 30 to 50% by weight of a mixture of n-paraffins and iso-paraffins containing at least 5 carbon atoms with a weight ratio of the amount of iso-paraffins to the amount of n-paraffins greater than or equal to 3, and from 5 to 15% by weight of naphthenes; then
2) mixing 60 to 94% by weight of said mixture (i) with 5 to 36% by weight of ethanol and 1 to 10% by weight of butane.

A second non-limiting embodiment comprises the following steps:

1') preparing a base B comprising the hydrocarbon mixture (i) and butane; then
2') mixing the base B with ethanol so that the ethanol content in the final composition is in the range from 5 to 36% by weight; and
3') optionally, adding butane, so that the amount of butane in the final mixture is in the range from 1 to 10% by weight.

One preferred alternative to this second embodiment comprises the following steps:

1') preparing a base B comprising the hydrocarbon mixture (i) and butane; and then
2') mixing from 64 to 95% by weight of the base B with from 5 to 36% by weight of ethanol; and preferably from 70 to 85% by weight of said base B with from 15 to 30% by weight of ethanol.

The second embodiment and its preferred alternative described above are preferred.

In this embodiment, base B is advantageously obtained from plant raw materials. Thus, base B is advantageously a biosourced base.

As preferred biosourced bases, those produced from biomass, converted into biohydrocarbons by known catalytic conversion methods can especially be used.

Similarly, ethanol is preferably bioethanol.

Thus, the composition according to the invention can be prepared entirely from raw materials of plant origin.

Uses

Another object of the invention is the use of the composition as described above to fuel a spark ignition engine. The engine may be of the direct injection or indirect injection type.

The fuel composition can advantageously be used both to fuel a conventional (so-called a "general public" engine) automobile vehicle engine and a high-efficiency, high-power spark ignition engine, such as a racing vehicle engine. This could especially be an atmospheric or turbocharged engine used in a racing vehicle (circuits or rallies), or a hybrid engine, that is an internal combustion engine coupled to an electric motor.

The following examples are intended solely to illustrate the invention and should not be interpreted as limiting the scope thereof.

EXAMPLES

Example 1

This example has been carried out using a biosourced hydrocarbon base B derived from transformation of bioalcohol derived from transformation of biomass.

Base B has the following composition:

TABLE 1

| Base B | |
|---|---|
| Compounds | Content (% by weight) |
| Olefins | 2.50 |
| $C_6$ to $C_{11}$ aromatic compounds | 46.6 |
| $C_5$ to $C_9$ N-paraffins | 6.3 |
| $C_5$ to $C_{11}$, including | 29.8 |
| $C_5$ to $C_7$, iso-paraffins | 22.3 |
| Naphthenes | 12 |
| Butane, including | 2.8 |
| n-butane | 1.5 |
| iso-butane | 1.3 |

A fuel composition C according to the invention has been prepared by mixing:

83.8% by weight of base B;

10.5% by weight of bioethanol;

3.8% by weight of butane;

1.9% by weight of bionaphtha.

The bionaphtha used has a density at 15° C. (according to standard NF EN ISO 12185) of 682.9 kg/m$^3$ and a distillation profile (according to standard NF EN ISO 3405) with a point E70=28.1° C.; E100=70.8° C. and E150=99.5° C.

Engine tests have been carried out using fuel C according to the invention on the one hand, and a commercial fuel of the SP95 E10 gasoline type (unleaded gasoline 95 of petroleum origin containing 10% by volume of ethanol) on the other hand.

During these tests, fuel C according to the invention, containing a very high proportion of a biosourced base, enabled satisfactory performance in terms of engine power to be obtained. Furthermore, compared with conventional SP95 E10 fuel, a 53% reduction in nitrogen oxide (NOx) emissions has been observed.

Example 2

Two fuel compositions C1 and C2 have been prepared by mixing two hydrocarbon bases with 32% by weight of bioethanol.

Composition C1 is in accordance with the invention and has been prepared using a hydrocarbon base in which the weight ratio of the amount of $C_{5+}$ iso-paraffins to the amount of $C_{5+}$ n-paraffins is 3.47 (24.66:7.11).

Its composition is detailed in Table 2 below.

TABLE 2

| Composition C1 | |
|---|---|
| Compounds | Content (% by weight) |
| Olefins | 0.95 |
| $C_{6+}$ aromatic compounds | 26.65 |
| $C_{5+}$ N-paraffins | 7.11 |
| $C_{5+}$ iso-paraffins | 24.66 |
| Naphthenes | 6.35 |
| Butane | 2.0 |
| Bioethanol | 32.0 |
| Other (especially $C_3$ paraffins) | 0.28 |

Composition C2 is a comparative composition, which has been prepared using a hydrocarbon base in which the weight ratio of the amount of $C_{5+}$ iso-paraffins to the amount of $C_{5+}$ n-paraffins is 2.14 (21.85:10.22).

Its composition is detailed in Table 3 below.

TABLE 3

| composition C2 | |
|---|---|
| Compounds | Content (% by weight) |
| Olefins | 0.96 |
| $C_{6+}$ aromatic compounds | 26.55 |
| $C_{5+}$ N-paraffins | 10.22 |
| $C_{5+}$ iso-paraffins | 21.85 |
| Naphthenes | 6.36 |
| Butane | 1.97 |
| Bioethanol | 32.0 |
| Other (especially $C_3$ paraffins) | 0.09 |

The RON (Research Octane Number) of each of these compositions has been measured in accordance with the method described in EN ISO 5164. The results obtained are detailed in the table below:

TABLE 4

| Results | |
|---|---|
| Composition | RON (EN ISO 5164) |
| C1-invention | 103 |
| C2-comparative | 100 |

Thus, composition C1 according to the invention has a very significantly higher measured RON than the comparative composition C2.

The invention claimed is:

1. A fuel composition comprising:

(i) from 60 to 94% by weight of a hydrocarbon mixture comprising:

a) from 35 to 55% by weight of aromatic compounds;

b) 30 to 50% by weight of a mixture of n-paraffins and iso-paraffins containing at least 5 carbon atoms with a weight ratio of the amount of iso-paraffins to the amount of n-paraffins greater than or equal to 3; and c) from 5 to 15% by weight of naphthenes;

(ii) from 5 to 36% by weight of ethanol; and (iii) from 1 to 10% by weight of butane.

2. The composition according to claim 1, wherein the hydrocarbon mixture (i) represents from 65 to 90% by weight relative to the total weight of the fuel composition.

3. The composition according to claim 1, wherein the aromatic compounds (i)a) are selected from the group consisting of alkyl-benzenes comprising from 7 to 12 carbon atoms and mixtures of alkyl-benzenes comprising from 8 to 10 carbon atoms.

4. The composition according to claim 1, wherein the content of the aromatic compounds (i)a) ranges from 40 to 53% by weight relative to the weight of the hydrocarbon mixture (i).

5. The composition according to claim 1, wherein the paraffins (i)b) are selected from paraffins comprising from 5 to 12 carbon atoms.

6. The composition according to claim 1, wherein the hydrocarbon mixture (i) contains from 5 to 10% by weight of n-paraffins and from 20 to 45% by weight of iso-paraffins.

7. The composition according to claim 1, wherein the content of paraffins (i)b) ranges from 32 to 45% by weight relative to the weight of the hydrocarbon mixture (i).

8. The composition according to claim 1, wherein the naphthenes (i)c) are selected from cyclic alkanes containing from 5 to 10 carbon atoms.

9. The composition according to claim 1, wherein the content of naphthenes (i)c) ranges from 7 to 13% by weight relative to the weight of the hydrocarbon mixture (i).

10. The composition according to claim 1, wherein its ethanol content ranges from 10 to 30% by weight relative to the total weight of the fuel composition.

11. The composition according to claim 1, wherein its butane content ranges from 1.5 to 8% by weight relative to the total weight of the fuel composition.

12. The composition according to claim 1, comprising at most 2.5% by weight of olefins.

13. The composition according to claim 1, wherein the hydrocarbon mixture (i) is derived from plant raw materials.

14. A method of operating a spark ignition engine, wherein said engine is powered by the composition as defined in claim 1.

15. The method according to claim 14, wherein said spark ignition engine is selected from an atmospheric spark ignition engine, a turbocharged spark ignition engine and a hybrid engine.

16. The method according to claim 14, wherein said spark ignition engine is a racing vehicle engine.

* * * * *